United States Patent [19]

Bolton

[11] 4,387,629

[45] Jun. 14, 1983

[54] DEVICE FOR EXTRACTING AIR FROM THE INTERIOR OF A STRUCTURE

[76] Inventor: Ross A. Bolton, 72 Cook St., North Ward, Townsville-4810, Queensland, Australia

[21] Appl. No.: 315,176

[22] Filed: Oct. 26, 1981

[30] Foreign Application Priority Data

Jan. 8, 1981 [AU] Australia ..... 66087/81

[51] Int. Cl.[3] ..... F23L 17/02

[52] U.S. Cl. ..... 98/78; 98/70

[58] Field of Search ..... 98/68, 70, 78

[56] References Cited

U.S. PATENT DOCUMENTS

| | | | |
|---|---|---|---|
| 761,680 | 6/1904 | Jacobson | 98/70 X |
| 1,362,342 | 12/1920 | Morey | 98/70 |
| 1,993,622 | 3/1955 | Peters et al. | 98/70 X |
| 2,310,331 | 2/1943 | Walker | 98/70 |

FOREIGN PATENT DOCUMENTS

| | | | |
|---|---|---|---|
| 10694 | 8/1909 | France | 98/70 |
| 518 | of 1869 | United Kingdom | 98/70 |
| 20554 | of 1895 | United Kingdom | 98/70 |
| 681457 | 10/1952 | United Kingdom | 98/70 |

*Primary Examiner*—Albert J. Makay

*Assistant Examiner*—Harold Joyce

*Attorney, Agent, or Firm*—K. H. Boswell; Edward D. O'Brian

[57] ABSTRACT

A device which is capable of being mounted on a structure and extracting air from the interior of the structure includes a housing having a hollow interior and open front and rear openings into the interior. Air is capable of moving into the front opening, through the interior of the housing and exiting out of the rear opening. A member, located within the interior of the housing, is capable of creating an area of reduced air pressure within the housing in response to air movement through the interior of the housing. A port is associated with the area of reduced air pressure and connects to a connecting member, which also attaches the housing to the structure. The connecting member is such that it allows for free rotation of the housing on the structure and simultaneously provides an air pathway between the interior of the structure and the interior of the housing. In response to an air pressure differential between the interior of the structure and the area of reduced pressure in the housing, air is extracted from the interior of the structure into the housing and expelled into the air moving through the housing.

12 Claims, 4 Drawing Figures

DEVICE FOR EXTRACTING AIR FROM THE INTERIOR OF A STRUCTURE

BACKGROUND OF THE INVENTION

This invention is directed to a device which extracts air from the interior of a structure and is useful during cataclysmic storms, wherein a pressure differential is created between the interior of the structure and the ambient environment. The device allows for reduction of the pressure within the interior of the structure to prevent the pressure differential within the interior of the structure from blowing the roof off of the structure. Further the device is useful for removing warm air from within the structure and ventilating the structure under normal climatic conditions.

In many areas of the world, local climatic conditions are such that storms are generated which have winds of excessive speed and force. In certain areas of the world, notably those areas where a continent is adjacent to a tropical ocean, certain large, catastrophic storms, generically referred to as tropical cyclones, occur. These tropical cyclones range in size from sixty to well over one thousand miles in diameter. Depending upon the location where these storms occur, they are known by a variety of names. The storms striking the North American Continent are commonly referred to as hurricanes, those striking the Asian Continent are commonly referred to as typhoons, and those striking the Australian Continent are commonly referred to as cyclones.

In order to be classed as a tropical cyclone, whether it be locally known as hurricane, typhoon, or cyclone, winds of generally in excess of sixty-five miles an hour must be present. Winds of less intensity are generally associated with storms referred to as tropical storms or tropical depressions.

Inhabited land masses which are subject to tropical cyclones incur large amounts of damage from passage of these storms over these land masses. The severity of the damage is, of course, in proportion to the severity of the storm, including the wind speed of the storm and the surge heighth of the waves accompanying the storms. Because of the wind forces associated with these tropical cyclones, pressure gradients are created within structures differing from the ambient pressure of the exterior environment of the structure. These pressure gradients are sometimes so severe with the tropical cyclones that it is not too uncommon for the roof of such a structure to be completely blown off.

Building codes in certain areas have been enacted to recognize the potential of these pressure gradients blowing the roof off of structures and sometimes require that the roof of the structure be engineered not only to support the downward force of the roof itself, but also be engineered to resist being blown off the structure. Unfortunately, not all areas of either the United States or the world which are subject to tropical cyclones include these building code provisions, and further, many older structures are not so engineered. As a result of this, much of the damage to structures during the passage of a tropical cyclone over an inhabited land mass includes damage to the structure because of the blowing off of the roof, and associated damage to the structure after the roof is no longer there to protect the interior of the structure.

There are many ventilating apparatus known which assist in removing hot or stale air from the interior of a structure to the ambient environment. These ventilating structures, however, are not engineered, nor designed, to withstand the extreme wind forces during a tropical cyclone, or to function in conjunction with these wind forces to dissipate the pressure within the interior of the structure. Indeed, most of the known ventilating structures simply present obstacles which are easily torn off of the structures to which they are attached by the high winds associated with the tropical cyclones. Once torn off or so removed from a structure, these free-floating devices then become dangerous solid obstacles being moved with lethal force by the winds of the tropical cyclone.

BRIEF DESCRIPTION OF THE INVENTION

In view of the above, it is obvious that there exists a drastic need for a device capable of reducing the pressure within the interior of a structure during the passage of a storm or tropical cyclone. It is therefore a broad object of this invention to provide a device capable of doing this.

It is a further object of this invention to construct such a device such that it will be stable on the roof of such a structure during the passage of such a tropical cyclone. It is a further object to construct a device which is capable of meeting the above object while still being simple in its engineering and concepts, such that it can stand for long periods of time on the roof of the structure during more favorable climatic time periods, yet be available for assisting in maintaining the integrity of the roof of the structure during the passage of a tropical cyclone without requiring any attention to the device prior to the passage of the tropical cyclone. It is a further object to provide a device which is constructed and manufactured in such a manner that the device will be reasonably economic, and thus be available for widespread use to alleviate the devastating effects of tropical cyclones. Additionally, it is an object to provide a device which also assists in ventilation and air circulation within the structure on a normal day-to-day basis.

These and other objects, as will become evident from the remainder of this specification, are achieved in a device which comprises: a housing having a hollow interior and including a front opening and a rear opening each of which opens into said interior of said housing, said front and said rear openings allowing for air flow into said front opening through said interior of said housing and exiting out of said rear opening; means located within interior of said housing and capable of creating an area of reduced air pressure within the interior of said housing in response to air moving through said interior of said housing; port means formed in said housing and located in association with said area of reduced air pressure; connecting means associated with said port means and rotatably connecting said housing to said structure such that said housing can freely rotate on said structure about an axis of rotation, said connecting means in association with said port means further connecting said area of reduced air pressure with the interior of said structure to allow for air to move from the interior of said structure into said housing in response to a pressure differential between the interior of said structure and said area of reduced air pressure; orientation means associated with said housing and capable under the influence of moving air of causing said housing to rotate about said axis of rotation to orientate said front opening of said housing in a direction pointing into said moving air.

Preferredly, the connecting means would include first and second upstanding members, each having an open bottom and top end. The first upstanding member would be capable of being attached to a structure in a position wherein the bottom opening of the first member is connected to the interior of the structure, allowing for air flow to move from the interior of the structure into the interior of the first member. The second upstanding member would attach to the first upstanding member such that its open bottom end is continuous with the open top end of the first member, and its open top end attaches to the housing about the port means to connect the interior of the second member to the area of reduced air pressure within the housing. The first and second members would be so associated with each other such that the second member would be capable of rotating with respect to the first member, allowing for rotation of the housing with respect to the structure, and allowing for air to move from the interior of the structure into the housing, through the interiors of the first and second members.

The first and second members can be formed to be cylindrical in shape and be coaxial with each other with a portion of one of them being capable of fitting within a portion of the other such that the second member is capable of rotating with respect to the first member.

The means capable of creating an area of reduced air pressure within the housing would include a baffle means positioned within the interior of the housing in association with the port means. The baffle means would form a constricted cross-sectional area somewhere within the interior of the housing, such that air, having moved through the constricted area, and then expanded, would form the area of reduced pressure within the housing.

Preferredly, the orientation means would include the housing being elongated in shape and having the connecting means and port means located close to the front opening, such that the axis of rotation of said housing is positioned approximate to the front opening. The remaining portion of the housing, located between the axis of rotation and the rear opening, would be capable of being contacted by moving air whenever the front opening of the housing was not oriented directly into the moving air or wind. As such, the force of moving air or wind on that portion of the housing located between the axis of rotation and the rear opening would be such that the force of said moving air would rotate the housing about the axis of rotation until the front opening was oriented into the moving air or wind.

The housing would be formed to include a shell, at least a portion of it being an elongated chamber with the front and rear openings of the housing being located at the respective front and rear ends of the chamber. The port means preferredly would comprise a bottom opening located in the bottom surface of the chamber. Preferredly, this bottom opening is located adjacent to the front opening, and the baffle means, which preferredly comprises a baffle having a first side and a second side, would be located within the chamber and positioned between the front opening and the bottom opening. The baffle means could further be formed to be arcuate in shape in cross-section, having a bottom edge and a top edge with the bottom edge of the baffle means located between the bottom opening and the front opening and the remainder of the baffle extending upwardly and inwardly from this bottom edge into the chamber such that the top edge of the baffle would be located at the constricted cross-sectional area of the chamber. As such, the area of reduced pressure would be formed beneath the baffle.

The area of the chamber having the constricted cross-sectional area could be further formed by including a waisted section in the shell between the front and rear ends of the chamber. This waisted section would have a smaller cross-sectional area than the cross-sectional area of the chamber at both the front and rear ends of the chamber. Preferredly, the chamber would be formed as a quadrilateral in cross-section, with its rear opening being serrated to assist in smooth air flow off of the rear end of the shell.

The connecting means could include a positioning means, located in the first member, and an elongated projection means attaching to the housing and projecting along the axis of rotation, axially through the second member such that the projection means is located to be operatively associated with the positioning means allowing the interaction of the projection means and the position means to support the housing on the first member. In the preferred embodiment, the position means would comprise a tube having an open upper end and a closed lower end, and located axially within the first member on the axis rotation. The projection means would preferredly comprise a rod attaching at its upper end to the baffle and projecting downwardly through the second member such that it is capable of fitting through the open upper end of the tube, and into the tube. Further, a bearing could be located against the closed bottom end of the tube such that the lower end of the rod contacts the bearing and is supported by the bearing, and can move on the bearing with a minimum of friction.

BRIEF DESCRIPTION OF THE DRAWINGS

The invention disclosed in this specification will be better understood when taken in conjunction with the drawings, wherein.

Figure 2:
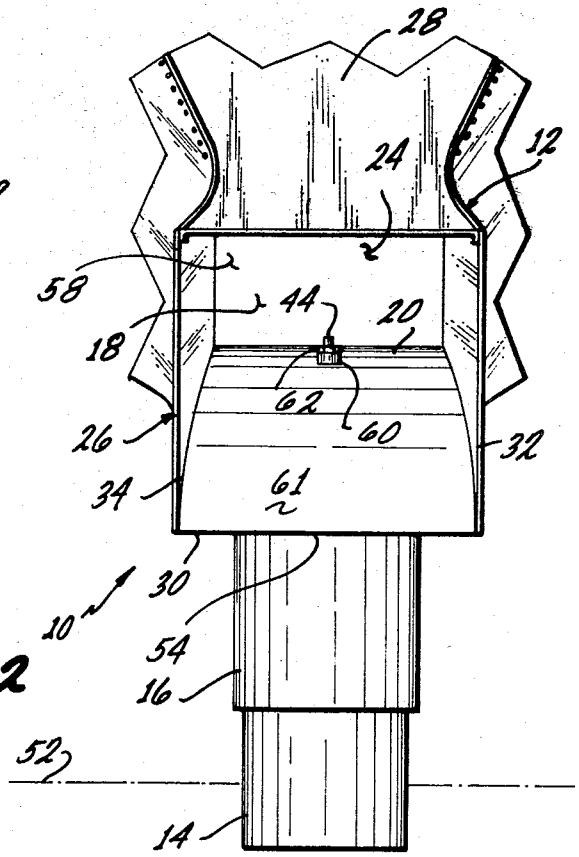
FIG. 2 is a front elevational view thereof.
Figure 1:
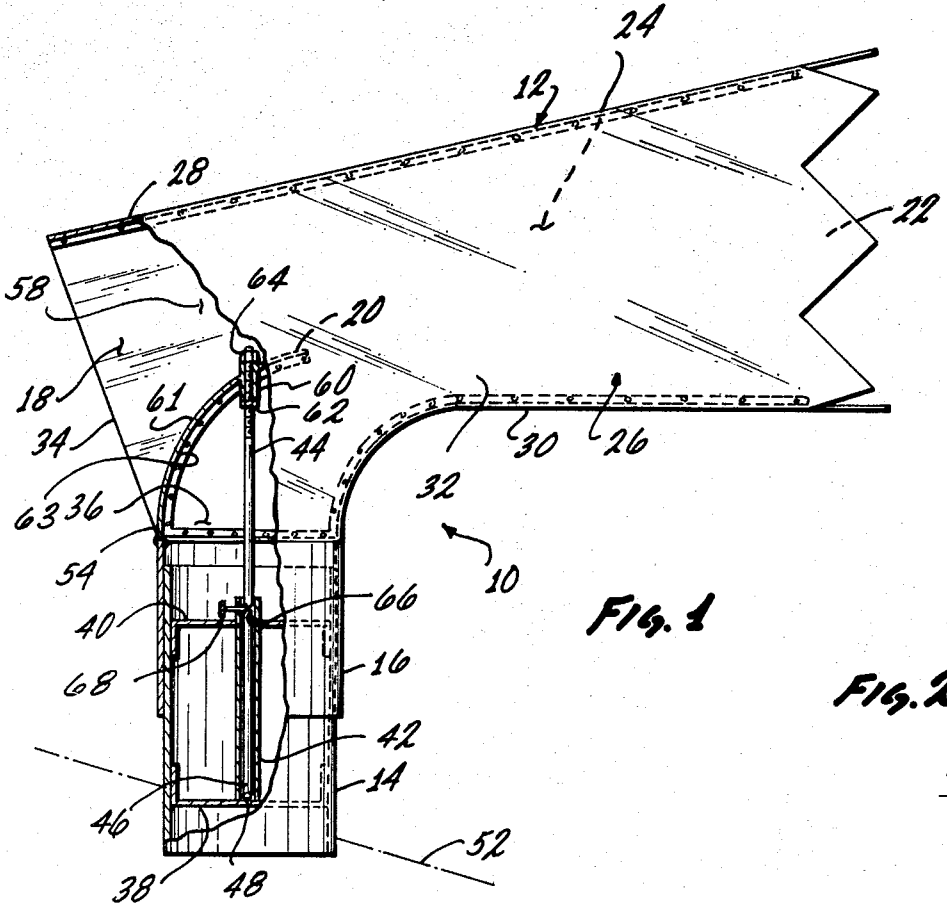
FIG. 1 is a side elevational view in partial section of the preferred embodiment of the invention.

The invention described in this specification and shown in the drawings utilizes certain principles and/or concepts as are set forth and claimed in the claims appended to this specification. Those skilled in the ventilation arts will realize that these principles and/or concepts are capable of being illustrated in a variety of embodiments, differing from the exact illustrative embodiment used herein. For this reason, this invention is not to be construed as being limited to the exact illustrated embodiment, but is to be construed as only being limited by the claims.

DETAILED DESCRIPTION OF THE INVENTION

Referring to the Figures, an illustrative embodiment of the invention is depicted therein. The air extracting device 10 includes a housing 12 and a first and second upright member, 14 and 16 respectively. Further, viewing through the front opening 18, a baffle 20 can be seen. The front opening 18, as well as a rear opening 22, allow for flow of air through the front opening 18 and into the interior 24 of the housing 12 and out of the rear opening 22.

The housing 12 is formed of a thin shell 26, made up of a top panel 28, a bottom panel 30 and right and left side panels, 32 and 34, respectively. In concert, these panels 28, 30, 32 and 34, form an elongated chamber which is generally oriented horizontally, however, as seen in the Figures, at least the top part thereof is slightly elevated toward the rear opening 22.

The respective panels 28, 30, 32 and 34, as well as other components described below, can be formed of sheet metal, aluminum, appropriate plastic which is weather resistant, such as ABS plastic or the like, or other similar materials which are generally light in weight yet have sufficient structural integrity to support both themselves from a structural standpoint, and to endure the forces which they are exposed to during a tropical cyclone. In the embodiment shown, the air extracting device 10 is formed of sheet metal which is riveted together along the appropriate seams (not separately numbered or identified) to form a monolithic, unified structure. Other joining methods such as welding, solvent welding, bending, folding and other suitable fasteners of course could be used, depending on the exact materials chosen for construction.

A bottom opening 36 within the housing 12 forms a port between the housing 12 and the second member 16, which surround it. The second member 16 is formed as a cylinder extending downwardly from the bottom opening 36. It is appropriately joined to the bottom opening 36 using typical sheet metal joining techniques and can also incorporate rivets and the like to assist in its structural integrity. The first member 14 is also cylindrical in shape, but is sized to have an outside dimension which is slightly smaller than the inside dimension of the second member 16. This allows for positioning of the second member 16 over the first member 14 and allows for free rotation of the second member 16 with respect to the first member 14, such that the housing 12 is capable of swinging around a full 360 degrees in an unencumbered or otherwise uninhibited manner.

Located in the interior of the first member 14 are bottom and top cross members 38 and 40, respectively. These cross members 38 and 40 support an upright tube 42. The tube 42 is closed at its bottom end by its abuttment against the bottom cross member 38. The tube 42, however, is open at its top end, allowing for a portion of a rod 44 to fit therein. The rod 44 is appropriately secured to the housing 12 as explained below, it being sufficient at this time to note that it extends downwardly from the housing 12 axially through the second member 16 and fits within the tube 42. The bottom end 46 of the rod 44 rests on a suitable ball bearing 48, which in turn is located in the bottom of tube 42. This allows for unencumbered rotation of the rod 44 within the tube 42.

The tube 42, as well as the rod 44, are both coaxial with the axis of the cylindrical members 14 and 16, and are located at the axis of rotation of the housing 12 about the members 14 and 16. The positioning of the rod 44 within the tube 42 in conjunction with the positioning of the first member 14 within the interior of the second member 16 provides for substantial support of the housing 12 on the first member 14 in a manner allowing for free rotation of the housing 12 about the member 14. The fit between the first and second members 14 and 16, as noted above, is such that a slight gap exists between the outside diameter of the member 14 and the inside diameter of the member 16. Additionally, the fit between the rod 44 and the tube 42 is such that there is also clearance allowing for free rotation of these respective components within themselves, in a manner such that a minimum of friction is developed, yet the housing 12 is fully supported on the member 14.

Figure 4:
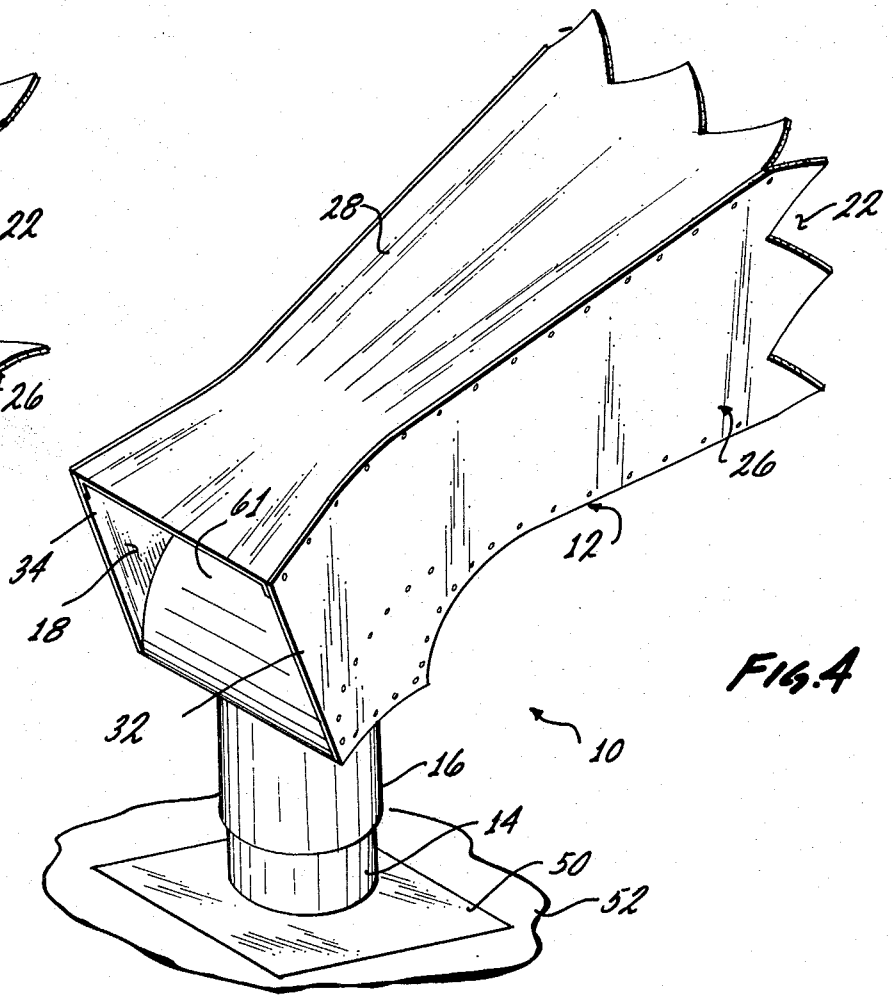
FIG. 4 is an isometric view, showing mounting of the invention onto an appropriate roof structure.
Figure 3:
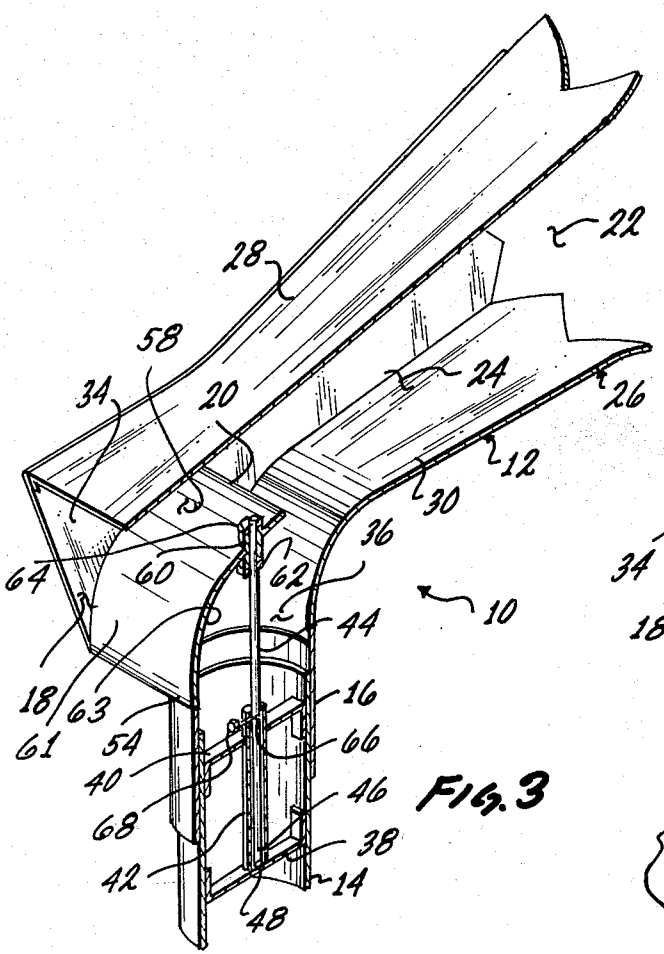
FIG. 3 is an isometric view in section thereof.

As seen in FIG. 4, the member 14 can be suitably attached to a plate, such as flashing plate 50, which in turn is attached to the top of a roof, such as roof 52. This is one way of mounting the air extracting device 10 onto a structure. The first member 14 would extend down through the plate 50 and into and through the roof 52 such that the interior of the first member 14 connected to the interior of the structure beneath the roof 52. This provides for an air pathway from the interior of the structure up into and through the members 14 and 16, into the housing 12. Additionally, the member 14 could pass through the roof 52 and directly attach to the framework or other structural components of the structure which support the roof 52, or are a part of roof 52. When so attached, member 14 would be appropriately affixed to the structure in a manner fixedly holding it to the structure. Appropriate attaching devices, such as clamps, straps, and the like could be utilized underneath the roof 52 to appropriately hold the first member 14 to the appropriate structural components, forming a portion of the roof 52 or a portion of the structure. Of course, a combination of both attaching to a flashing and to the structural frame of the roof could be utilized.

The baffle 20 curves in an arcuate manner from its lower edge 54, which is located directly between the lowermost portion of the front opening 18 and the forwardmost portion of the bottom opening 36. From the lower edge 54, the buffle 20 curves upwardly and inwardly into the chamber formed by the appropriate panels 28, 30, 32 and 34 of the housing 12. The upper edge of the baffle 20 is located within the interior of the housing 12 at a position displaced inwardly from the front opening 18. It can be seen from the Figs. that this placement and shape of baffle 20 forms a constricted area 58 within the interior of the housing 12.

Air entering through the front opening 18 is forced to travel along and against the front side or surface 61 of the baffle 20, through the constricted area, which increases its speed because of the reduction of the volume within the housing 12 at the constructed area 58. As the air moves past the constricted area 58, it is allowed to expand in the rearmost portions of the housing 12, and in doing so, it creates a low pressure area directly underneath the rear side or surface 63 of the baffle 20. This low pressure area is in association with the bottom opening 36, and as such, air from within the interior of the structure is induced to flow up through the first and second members 14 and 16, into this low pressure area, in order to equalize the differences between the pressure within the interior of the housing and the pressure at this point. This differential of pressure created between the interior of the structure and the interior of the housing 12 efficiently extracts air from within the structure, into housing 12. The air from the interior of the structure, having moved into the area beneath the baffle 20, then is contained in the air stream moving through the housing 12, and is exhausted out of rear opening 22, into that air stream.

The baffle 20 abutts against, and is fixedly attached to the right and left side panels 32 and 34, such that the baffle 20 forms a sufficient foundation member within the housing 12, for attaching the rod 44.

A small tube 60 is fixedly attached to the baffle 20 right at the center rotation of the housing 12. The upper end of the rod 44 is threaded and fits through the tube 60. A nut 62 and a nut 64 are appropriately located on the threaded portion of the rod 44, above and below the tube 60, to fixedly hold the rod 44 to the tube 60, which in turn holds it to the baffle 20, which in turn holds it to the housing 12. If desired, the rod 44 could extend upwardly and through the top panel 28 and be appropriately mounted or joined to this panel 28 for increased stability of the structure. It has been found, however, that this is not necessary in the preferred embodiment shown in the Figs.

A groove 66 is cut in the rod 44 and the tube 42 includes an appropriate hole, such that a set screw 68 can be threaded therein. The end of the set screw fits within the groove 66. The groove 66 is of a sufficient width however, that the set screw does not contact either the sides or the bottom of the groove, allowing for free rotation of the rod 44 with respect to the set screw 68. The set screw 68 being located within the groove 66 however, prevents the housing 12 from being lifted upwardly off of the first member 14.

In mounting the device 10 onto a roof, first the first member 14 would be appropriately fixedly secured to the roof or structural components of the structure of the roof. This would be followed by inserting the rod 44 into the tube 60 and setting the set screw 68 into the groove 66. Then the nut 62 would be appropriately secured on to the top of the rod 44, followed by an appropriate washer or the like, if desired. The houusing 12 would then be set onto the top of the rod 44 by inserting the rod 44 through the tube 60, and finally secured thereto by the nut 64. The nut 64 could be conveniently screwed onto the top of rod 44 simply by manipulation through the front opening 18.

Preferredly, the rod 44 is a brass rod such that it will not corrode when exposed to the elements, and thus be free to turn within the tube 42 many years after its appropriate insertion therein. Preferredly, the second member 16 fits over the first member 14 such that rain and the like is prevented from being retained inbetween these two members to corrode or otherwise destroy their integrity. This also serves to prevent moisture introduction into the interior of the structure on which the device 10 is mounted. Because of the presence of the baffle 20, upwardly and over the bottom opening 36, and the presence of the top panel 28, rain is also precluded from entering into the interior of the housing 12 and through the members 14 and 16, to the structure itself.

In the preferred embodiment shown in the Figs., the panels 28, 30, 32 and 34 are constructed such that a waisted, or narrower, area 70 is formed in each of them, in conjunction with the constricted area 58 formed by the baffle 20. The waisted area 70 contributes to the Venturi tube effect produced by the baffle 20 and increases the reduction of pressure in the area immediately below the baffle 20.

The upward flare of the housing 12, as seen in the Figs., mainly produced by the slant of the top panel 28 and the top of the right and left side panels 32 and 34, assist in maintaining the housing 12 onto the structure to which it is mounted. High velocity winds flowing across the top panel 28 create a downward pressure against the upward slant of this panel, pushing the air extraction device 10 downwardly against the roof. This, in combination with the nut 62 and the nut 64 on the rod 44 and the set screw 68 on the groove 66 can serve to fixedly maintain the air extraction device 10 onto the structure on which it is mounted during high velocity winds, as described below.

The portions of the panels 28, 30, 32 and 34, which surround the rear opening 22 are serrated, as is seen in the Figs. This allows for better aerodynamic flow off of the rear of the housing 12 during high winds. It is, of course, not necessary to include the serrations; however, they do assist in increasing the efficiency of air flow across and through the device during high velocity winds.

During hurricane force winds, i.e., tropical cyclone winds exceeding about 65 knots, air movement of these high velocity winds through the front opening 18 across the baffle 20, and through the remainder of the interior 24 of the housing 12, and exiting out of the rear housing 22, produce the area of reduced air pressure below the baffle 20. The reduction in pressure created in this area is related to the velocity of the winds flowing through the device 10. The greater the velocity of the wind, the greater is this reduction of air pressure in this area. This serves to increase the efficiency of the device 10 in depressurizing the area beneath the roof of a structure during these severe winds. The pressure differential created between the interior of the structure and the reduced air pressure within the housing 12 sufficiently withdraws the excessive pressure from within the structure to prevent cataclysmic loss of its roof.

An embodiment of the air extraction device 10 was field tested on a structure in Australia during actual passage of a tropical storm, known in Australia simply as a cyclone. The structure to which the device 10 was mounted maintained its roof during the passage of the cyclone, whereas the roof of a structure adjacent to this structure was blown off by this cyclone. Further, in static testing of the device, the device 10 was mounted in association with a wind generator which was capable of generating winds up to 110 miles per hour. The wind generator was adjusted to maximum velocity such that a wind velocity of 110 miles an hour was generated. The device 10 withstood these winds and maintained its location on its mountings. The 110 mile an hour limitation of this test was based solely on the inability of the wind generator to develop winds in excess of this velocity. In any event, the device 10 is capable of withstanding hurricane force winds.

While the device 10 is primarily designed to assist in preventing the loss of the roof, or other damage to a structure during tropical cyclones, it also serves as a ventilation means for these structures during milder climatic conditions. Movement of any air through the device 10 results in generation of an area of reduced pressure beneath the baffle 20. Thus, the device 10 serves as a ventilator of any structure to which it is attached and needs only a gentle breeze to produce the area of reduced air pressure in order to extract air from the structure to which it is attached. As such, it functions similar to the more common, spherical type wind turbines for exhausting the hot air from structures which accumulates directly underneath the roof of these structures.

In the embodiment shown, the portion of the housing 12 which is located between the axis of rotation, i.e., the axis of the rod 44, and the rear opening 22, serves as an orientation means to maintain the front opening 18 pointed directly into the wind, or into the moving air. If the housing 12 is located at any orientation other than facing directly into the wind, the force of this wind against either of the right or left side panels 32 or 34 will pivot or swivel the housing 12 about the rod 44 such that the front opening 18 will be oriented directly into the wind or moving air. If the wind or moving air swirls or otherwise changes course, the housing 12 immediately pivots about the rod 44 to maintain the orientation of the front opening 18 directly into the wind. In using the terminology "into the wind", this terminology is used in a manner consistent with nautical terminology.

It is evident that the physical size of the air extraction device 10 can be changed to increase or decrease its capacity of exhausting air from a structure. For larger structures, of course a device 10 of larger physical dimensions would be constructed, or a mulitiplicity of devices 10 used, whereas for smaller structures, a smaller dimension device 10 would suffice. Optimum sizing of the device 10 would be made by appropriate consideration of the square footage of area of the structure upon which it is to be used.

The downward slant of the front opening 18 of the device 10 assists in preventing entry of dust, dirt, moisture and the like into the interior of the housing 12. While not necessary for the function of the device 10, the front opening 18 could be augmented by extending the lower edge 54 of the baffle 20 outwardly and downwardly such that this portion of the baffle 20 was actually located external of the opening 18. This simply serves to present a wider cross sectional area of the front opening 18.

I claim:

1. A device for extracting air from the interior of a structure which comprises:

a housing having a hollow interior and including a front opening and a rear opening, each of which opens into said interior of said housing, said front and said rear openings allowing for air flow into said front opening through said interior of said housing and exiting out of said rear opening, said housing including a shell at least a portion of which is formed as an elongated chamber, said front opening and said rear opening of said housing located at respective front and rear ends of said chamber;

baffle means positioned within the interior of said housing, said baffle means forming a constricted cross sectional area within the interior of said housing and capable of creating an area of reduced air pressure within the interior of said housing in response to air moving through said interior of said housing;

port means formed in said housing and located in association with said baffle means and said area of reduced air pressure and including said port means comprising a bottom opening located on the bottom surface of said chamber adjacent to said front opening;

connecting means associated with said port means and rotatably connecting said housing to said structure such that said housing can freely rotate on said structure about an axis of rotation, said connecting means in association with said port means further connecting said area of reduced air pressure within the interior of said structure to allow said air to move from the interior of said structure into said housing in response to a pressure differential between the interior of said structure and the area of reduced air pressure;

orientation means associated with said housing and capable under the influence of moving air of causing said housing to rotate about said axis of rotation to orient said front opening of said housing in a direction pointing into said moving air, said orientation means comprising said housing being elongated in shape and said connecting means and said port means both being located proximal to said front opening and said portion of said housing located between said rear opening and said axis of rotation being of a substantially greater elongated dimension than said portion of said housing located between said front opening and said axis of rotation such that said axis of rotation of said housing is positioned proximal to said front opening and the portion of said housing located between said axis of rotation and said rear opening is capable of being contacted by said moving air whenever said front opening is not oriented in a direction pointing into said moving air and when said portion of said housing located between said axis of rotation and said rear opening is contacted by said moving air, the force of said moving air against said portion rotates said housing about said axis of rotation until said front opening is oriented in a direction pointing into said moving air.

2. The device of claim 1 wherein:

said connecting means includes a first upstanding member having a hollow interior and open bottom and top ends, said first member capable of being attached to said structure in a position wherein said bottom opening of said first member connects to the interior of said structure in a manner allowing for air to move from the interior of said structure into the interior of said first member;

a second upstanding member having a hollow interior and open bottom and top ends, said top end of said second member attaching to said housing about said port means connecting the interior of said second member to said area of reduced air pressure within said housing;

said first and second members associated with each other such that said second member is capable of rotating with respect to said first member and air is capable of moving between said respective interiors of said first and said second members.

3. The device of claim 2 wherein:

each of said first and said second members are cylindrical in shape and are coaxial with each other with one of said first or said second members being capable of fitting within at least a portion of the other of said first or said second members such that said second member is capable of rotating with respect to said first member.

4. The device of claim 3 wherein:

said baffle means has a first side and a second side, said front opening being located on said first side of said baffle means and said port means being located on said second side of said baffle means.

5. The device of claim 1 wherein:

said baffle means comprising a baffle located within said chamber and positioned between said front opening and said bottom opening, said baffle is arcuate in shape and includes a bottom edge and a top edge, said bottom edge of said baffle located between said bottom opening and said front opening, said baffle extending upwardly and inwardly from said bottom edge into said chamber, locating said top edge of said baffle in said constricted cross sectional area such that air moving through said chamber and through said constricted cross sectional area forms said area of reduced air pressure beneath said baffle.

6. The device of claim 5 wherein:

said constricted cross sectional area is further formed by including a waisted section in said shell between said front end and said rear end of said chamber, said waisted section being a smaller cross-sectional area than the cross-sectional area of said chamber at said front and said rear ends.

7. The device of claim 6 wherein:

said chamber is quadrilaterally shaped in cross-section.

8. The device of claim 7 wherein:

said rear openings is serrated.

9. The device of claim 8 wherein:

said connecting means includes a positioning means located in one of said first member or said housing, and an elongated projection means attaching to the other of said first member or said housing and projecting along said axis of rotation axially through said second member, said projection means operatively associated with said positioning means supporting said housing on said first member.

10. The device of claim 9 wherein:

said positioning means comprises a tube having an open upper end and a closed lower end and located axially within said first member on said axis of rotation, said projection means comprising a rod attaching at its upper end to said baffle and projecting downwardly through said second means, and fitting through said open upper end of said tube into said tube and further including a bearing means located against said closed bottom end of said tube such that said lower end of said rod contacts said bearing means and is supported by said bearing means and said closed end of said tube.

11. The device of claim 7 wherein:

said shell includes a top wall, left and right side walls, and a bottom wall, said top wall projecting horizontally and upwardly from said front opening, said left and right side walls projecting rearwardly and inwardly to said waisted section and then rearwardly and outwardly to said rear opening, the forward edge of said top wall and said side walls defining a portion of said front opening;

said orientation means comprising said portion of said side walls positioned between said waisted section and said rear opening.

12. The device of claim 11 wherein:

said bottom edge of said baffle defines the bottommost portion of said front opening and the uppermost portion of said front opening defined by the front edge of said top wall is displaced at a greater distance from said axis of rotation than is said bottom edge of said baffle.

* * * * *